US009032733B2

(12) United States Patent
Dalsania et al.

(10) Patent No.: US 9,032,733 B2
(45) Date of Patent: May 19, 2015

(54) TURBOMACHINE SYSTEM WITH DIRECT HEADER STEAM INJECTION, RELATED CONTROL SYSTEM AND PROGRAM PRODUCT

(71) Applicant: General Electric Company, Schenectady, NY (US)

(72) Inventors: Prakash Bavanjibhai Dalsania, Bangalore (IN); Nestor Hernandez Sanchez, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 224 days.

(21) Appl. No.: 13/856,953

(22) Filed: Apr. 4, 2013

(65) Prior Publication Data

US 2014/0298808 A1 Oct. 9, 2014

(51) Int. Cl.

| | |
|---|---|
| ***F01K 13/02*** | (2006.01) |
| ***F01K 7/22*** | (2006.01) |
| ***F01K 21/00*** | (2006.01) |
| ***F01K 17/00*** | (2006.01) |
| ***F01K 17/06*** | (2006.01) |
| ***F01K 7/34*** | (2006.01) |
| ***F01K 7/36*** | (2006.01) |

(52) U.S. Cl.

CPC ..... *F01K 21/00* (2013.01); *F01K 17/00* (2013.01); *F01K 17/06* (2013.01); *F01K 7/34* (2013.01); *F01K 7/36* (2013.01)

(58) Field of Classification Search

USPC ..... 60/646, 657, 660, 662, 663, 653, 677; 415/1, 20

See application file for complete search history.

(56) References Cited

U.S. PATENT DOCUMENTS

| | | | | |
|---|---|---|---|---|
| 3,051,438 | A | | 8/1962 | Page et al. |
| 3,746,462 | A | | 7/1973 | Fukuda |
| 4,541,247 | A | * | 9/1985 | Martin ..... 60/660 |
| 5,167,486 | A | | 12/1992 | Detanne |
| 5,388,411 | A | * | 2/1995 | McKeever et al. ..... 60/646 |
| 5,634,766 | A | | 6/1997 | Cunha et al. |
| 5,743,708 | A | | 4/1998 | Cunha et al. |

(Continued)

FOREIGN PATENT DOCUMENTS

JP 2005320876 A 11/2005

OTHER PUBLICATIONS

U.S. Appl. No. 13/325,691, filed Dec. 14, 2011.

(Continued)

*Primary Examiner* — Hoang Nguyen

(74) *Attorney, Agent, or Firm* — Ernest G. Cusick; Hoffman Warnick LLC

(57) ABSTRACT

Various embodiments of the invention include a system including: at least one computing device operably connected with a steam turbomachine and an extraction conduit fluidly connected with the steam turbomachine and a steam seal header fluidly coupled with the steam turbomachine, the at least one computing device configured to modify an output of the steam turbomachine by performing actions including: determining a pressure within the steam turbomachine; comparing the pressure within the steam turbomachine with a pressure threshold range; and instructing the extraction conduit to extract steam seal header steam from the steam seal header and provide the extracted steam seal header steam to the steam turbomachine in response to determining the pressure within the steam turbomachine deviates from the pressure threshold range.

19 Claims, 4 Drawing Sheets

(56) References Cited

U.S. PATENT DOCUMENTS

| | | | | |
|---|---|---|---|---|
| 6,007,296 | A | 12/1999 | Ernst et al. | |
| 6,036,436 | A | 3/2000 | Fukuno et al. | |
| 6,272,861 | B1 | 8/2001 | Bergmann | |
| 6,315,518 | B1 | 11/2001 | Uematsu et al. | |
| 6,354,798 | B1 | 3/2002 | Deckers | |
| 6,585,479 | B2 | 7/2003 | Torrance | |
| 6,705,086 | B1 * | 3/2004 | Retzlaff et al. | 60/653 |
| 6,929,445 | B2 | 8/2005 | Zatorski et al. | |
| 7,040,861 | B2 * | 5/2006 | Clifford et al. | 415/174.2 |
| 7,264,445 | B2 | 9/2007 | Naik et al. | |
| 8,152,445 | B2 | 4/2012 | Guemmer | |
| 8,545,166 | B2 * | 10/2013 | Maruthamuthu et al. | 415/1 |
| 8,650,878 | B2 * | 2/2014 | Mehra et al. | 60/646 |
| 2006/0153673 | A1 | 7/2006 | Guemmer | |
| 2007/0014670 | A1 | 1/2007 | Maeno | |
| 2011/0097198 | A1 | 4/2011 | Sanchez | |

OTHER PUBLICATIONS

U.S. Appl. No. 12/606,530, Office Action dated Feb. 7, 2013.

Younger, Notice of Allowance and Fee(s) Due for U.S. Appl. No. 12/606,530 dated Jul. 19, 2013, 9 pages.

* cited by examiner

TURBOMACHINE SYSTEM WITH DIRECT HEADER STEAM INJECTION, RELATED CONTROL SYSTEM AND PROGRAM PRODUCT

FIELD OF THE INVENTION

The subject matter disclosed herein relates to power systems. More particularly, the subject matter disclosed herein relates to turbomachine devices and related control features.

BACKGROUND OF THE INVENTION

Turbomachines, such as steam turbines, are designed to translate the fluidic motion of a working fluid (e.g., steam) into rotational motion that can be used to perform mechanical work. Some power systems include multiple turbomachines (e.g., steam turbines), including one or more high-pressure (HP), intermediate-pressure (IP), and low-pressure (LP) sections. These sections are sometimes joined along a common shaft, or along disjoined shafts, and each section is conventionally sealed at an axial end by a steam seal header (or simply, "header"). The header is typically pressurized by providing fluid (e.g., steam) flow to the header region to prevent working fluid from exiting the turbine at the interface of the turbine's casing and the shaft. Due to a variety of factors, the header region typically produces leakage steam, at least some of which is diverted to the condenser.

BRIEF DESCRIPTION OF THE INVENTION

Various embodiments of the invention include a system including: at least one computing device operably connected with a steam turbomachine and an extraction conduit fluidly connected with the steam turbomachine and a steam seal header fluidly coupled with the steam turbomachine, the at least one computing device configured to modify an output of the steam turbomachine by performing actions including: determining a pressure within the steam turbomachine; comparing the pressure within the steam turbomachine with a pressure threshold range; and instructing the extraction conduit to extract steam seal header steam from the steam seal header and provide the extracted steam seal header steam to the steam turbomachine in response to determining the pressure within the steam turbomachine deviates from the pressure threshold range.

A first aspect of the invention includes a system having: at least one computing device operably connected with a steam turbomachine and an extraction conduit fluidly connected with the steam turbomachine and a steam seal header fluidly coupled with the steam turbomachine, the at least one computing device configured to modify an output of the steam turbomachine by performing actions including: determining a pressure within the steam turbomachine; comparing the pressure within the steam turbomachine with a pressure threshold range; and instructing the extraction conduit to extract steam seal header steam from the steam seal header and provide the extracted steam seal header steam to the steam turbomachine in response to determining the pressure within the steam turbomachine deviates from the pressure threshold range.

A second aspect of the invention includes a system including: a steam turbomachine section including a casing and a diaphragm at least partially contained within the casing; a flow path fluidly coupled with the steam turbomachine section; a steam seal header sealing a portion of the flow path; an extraction conduit fluidly connected with the steam seal header and the diaphragm; and a control system operably connected to the extraction conduit and the steam turbomachine section, the control system configured to: extract steam seal header steam from the steam seal header; and provide the extracted steam seal header steam to the diaphragm in response to detecting a predetermined pressure condition in the steam turbomachine section.

A third aspect of the invention includes a computer program product comprising program code stored on a computer readable medium, which when executed by at least one computing device, causes the at least one computing device to modify an output of a steam turbomachine by performing actions including: determining a pressure within the steam turbomachine; comparing the pressure within the steam turbomachine with a pressure threshold range; and initiating extraction of steam from a steam seal header connected with the steam turbomachine and providing the extracted steam seal header steam to the steam turbomachine in response to determining the pressure within the steam turbomachine deviates from the pressure threshold range.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
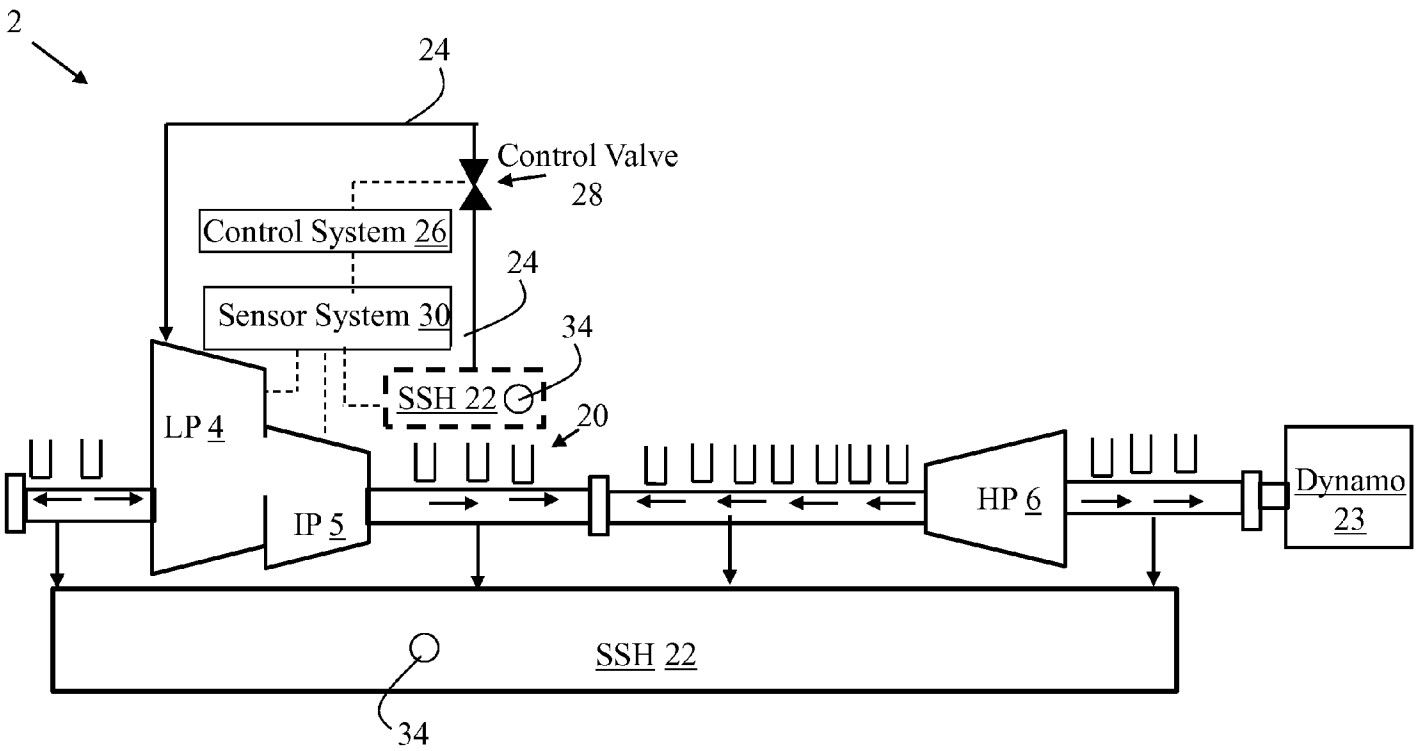
FIG. 1 shows a schematic depiction of a system according to various embodiments of the invention.

As indicated above, aspects of the invention relate to power systems. More particularly, the subject matter disclosed herein relates to turbomachine devices and related control features.

In the following description, reference is made to the accompanying drawings that form a part thereof, and in which is shown by way of illustration specific example embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

As used herein, the terms "axial" and/or "axially" refer to the relative position/direction of objects along an axis A, which is substantially parallel with the axis of rotation of the turbomachine (in particular, the rotor section). As further used herein, the terms "radial" and/or "radially" refer to the relative position/direction of objects along axis (r), which is substantially perpendicular with axis A and intersects axis A at only one location. Additionally, the terms "circumferential" and/or "circumferentially" refer to the relative position/direction of objects along a circumference which surrounds axis A but does not intersect the axis A at any location.

As noted herein, turbomachines (e.g., steam turbines) are designed to translate the fluidic motion of a working fluid (e.g., steam) into rotational motion that can be used to perform mechanical work. Some power systems include multiple turbomachines (e.g., steam turbines), including one or more high-pressure (HP), intermediate-pressure (IP), and low-pressure (LP) sections. These sections are sometimes joined along a common shaft, or along disjoined shafts, and each section is conventionally sealed at an axial end by a steam seal header (or simply, "header"). The header is typically pressurized by providing fluid (e.g., steam) flow to the header region to prevent working fluid from exiting the turbine at the interface of the turbine's casing and the shaft. Due to a variety of factors, the header region typically produces leakage steam, at least some of which is diverted to the condenser.

Various embodiments of the invention are directed toward turbomachine systems that utilize leakage steam from the steam seal header (or simply, "header") to enhance the efficiency of a turbomachine, e.g., a steam turbine. The systems can include at least one steam turbine coupled with a control system. The control system can initiate extracting of steam from the header region and injecting that extracted steam into a stage of a turbomachine (e.g., a steam turbine, such as a low pressure (LP) steam turbine). The control system can monitor a pressure in the steam path to determine in which location in the steam turbine to inject the extracted steam. In some cases, the location(s) can be predetermined (e.g., apertures may be pre-fabricated in the steam turbine to allow for injection of the steam).

In various embodiments of the invention, the header extraction steam is directly injected through the steam turbine diaphragm body, e.g., through a hollow section of the diaphragm body. In some embodiments of the invention, the steam turbine diaphragm body includes an aperture extending through the hollow section for receiving the extracted header steam. In contrast to other conventional approaches to enhance steam turbine performance, the various embodiments of the invention directly inject extracted header steam through the diaphragm body and into a stage of the steam turbine. In some cases, the stage of the steam turbine is the last (L0) or second-to-last (L1) stage of the steam turbine. That is, steam may be directed to the hollow diaphragm section proximate a stage (e.g., an L0, L1, L2, etc.) of the turbine, and can then be admitted to the steam path through apertures in the diaphragm at that stage. The admission holes can be arranged to minimize flow losses when the admitted steam is mixed with the main flow path. In various embodiments, introducing hotter steam from the steam seal header (when compared with main flow path steam), will delay the nucleation process in the main steam flow, thereby improving performance of the steam turbine.

Various particular embodiments of the invention include a system having: at least one computing device operably connected with a steam turbomachine and an extraction conduit fluidly connected with the steam turbomachine and a steam seal header fluidly coupled with the steam turbomachine, the at least one computing device configured to modify an output of the steam turbomachine by performing actions including: determining a pressure within the steam turbomachine; comparing the pressure within the steam turbomachine with a pressure threshold range; and instructing the extraction conduit to extract steam seal header steam from the steam seal header and provide the extracted steam seal header steam to the steam turbomachine in response to determining the pressure within the steam turbomachine deviates from the pressure threshold range.

Other particular embodiments of the invention include a system including: a steam turbomachine section including a casing and a diaphragm at least partially contained within the casing; a flow path fluidly coupled with the steam turbomachine section; a steam seal header sealing a portion of the flow path; an extraction conduit fluidly connected with the steam seal header and the diaphragm; and a control system operably connected to the extraction conduit and the steam turbomachine section, the control system configured to: extract steam seal header steam from the steam seal header; and provide the extracted steam seal header steam to the diaphragm in response to detecting a pressure in the steam turbomachine section.

Further particular embodiments of the invention include a computer program product comprising program code stored on a computer readable medium, which when executed by at least one computing device, causes the at least one computing device to modify an output of a steam turbomachine by performing actions including: determining a pressure within the steam turbomachine; comparing the pressure within the steam turbomachine with a pressure threshold range; and initiating extraction of steam from a steam seal header connected with the steam turbomachine and providing the extracted steam seal header steam to the steam turbomachine in response to determining the pressure within the steam turbomachine deviates from the pressure threshold range. In various embodiments, the computer program product can cause the at least one computing device to modify a location for admission of steam to the turbomachine based upon the turbomachine's operating load.

Various additional particular embodiments of the invention include a system, e.g., a turbomachine system. The system can include: a steam turbomachine section including a casing and a diaphragm at least partially contained within the casing; a flow path fluidly coupled with the steam turbomachine section; a steam seal header sealing a portion of the flow path; an extraction conduit fluidly connected with the steam seal header and the diaphragm of the steam turbomachine section; and a control system operably connected to the extraction conduit and the steam turbomachine section, the control system configured to: extract steam seal header steam from the steam seal header; and provide the extracted steam seal header steam to the diaphragm in response to detecting a predetermined pressure condition in the steam turbine section.

Various further embodiments of the invention include a turbomachine system that includes: a first steam turbomachine section including a casing and a diaphragm at least partially contained within the casing; a second steam turbomachine section fluidly coupled with the first steam turbine turbomachine; a flow path fluidly coupling the first steam turbomachine section and the second steam turbomachine section; a steam seal header sealing a portion of the flow path; an extraction conduit fluidly connected with the steam seal header and the diaphragm of the first steam turbomachine section; and a control system operably connected to the extraction conduit and the first steam turbomachine section, the control system configured to: extract steam seal header steam from the steam seal header; and provide the extracted steam seal header steam to the diaphragm in response to detecting a pressure condition in the first steam turbine section.

Even further embodiments of the invention include a system having: at least one computing device operably connected with a steam turbomachine and an extraction conduit fluidly connected with the steam turbomachine and a steam seal header fluidly coupled with the steam turbomachine, the at least one computing device configured to modify an output of the steam turbomachine by performing actions including: obtaining data about a pressure condition within the steam turbomachine; comparing the data about the pressure condition with a predetermined pressure condition threshold range; and initiating the extraction conduit to extract steam seal header steam from the steam seal header and provide the extracted steam seal header steam to the steam turbomachine in response to determining the data about the pressure condition deviates from the predetermined pressure condition threshold range.

FIG. 1 shows a schematic depiction of a system 2 according to various embodiments of the invention. As shown, the system 2 can include a turbomachine system, e.g., a system including at least one turbomachine (such as a steam turbine). In some cases, the system 2 can include a first steam turbomachine section (e.g., a low pressure (LP) steam turbine) 4, a second steam turbomachine section (e.g., an intermediate pressure (IP) steam turbine) 5 and a third turbomachine section (e.g., a high pressure (HP) steam turbine) 6. In the example embodiment shown, the first steam turbomachine section 4 and second steam turbomachine section 5 include a joint LP/IP steam turbomachine section. In various embodiments, each steam turbomachine section (e.g., LP steam turbine 4) includes a casing and a diaphragm at least partially contained within the casing.

Figure 2:
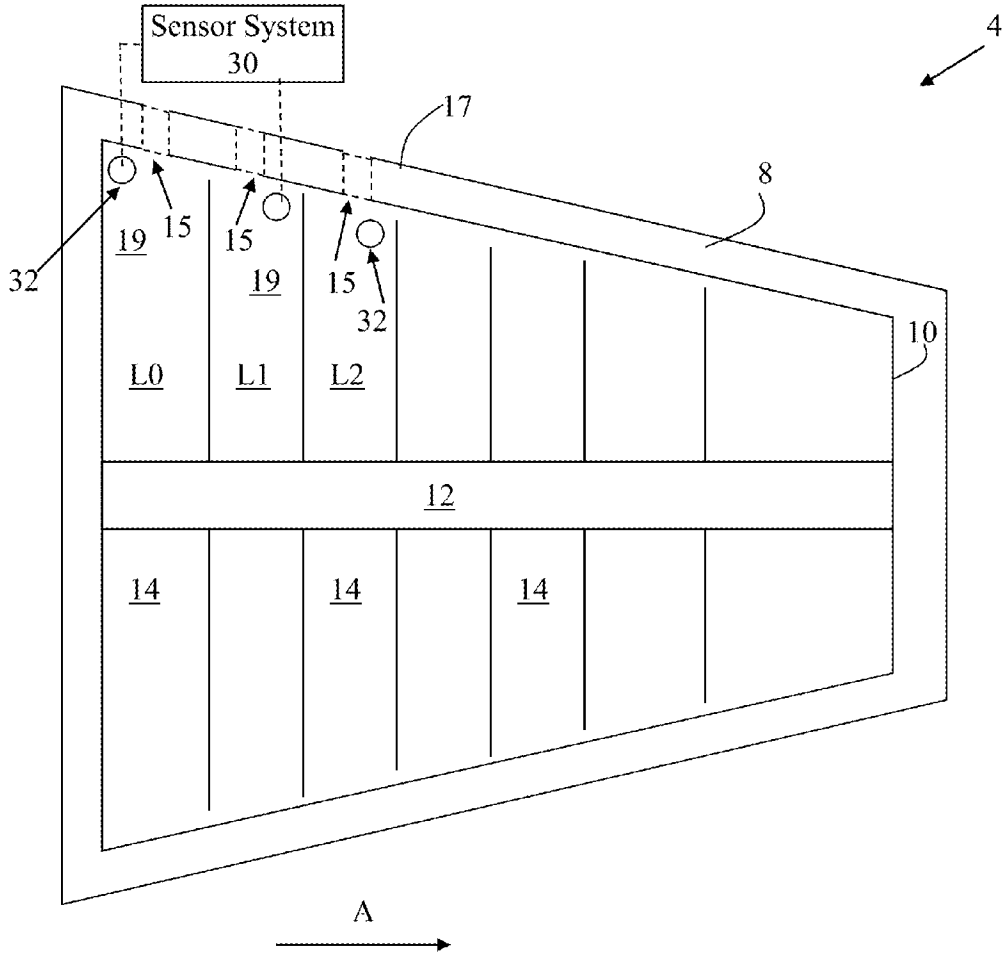
FIG. 2 shows a close-up schematic depiction of a steam turbomachine section according to various embodiments of the invention.

FIG. 2 shows a schematic cross-sectional depiction of a steam turbomachine, e.g., an LP steam turbine 4. The LP steam turbine 4 includes a casing 8, and a diaphragm 10 at least partially contained within the casing 8. The diaphragm 10 encompasses a rotor body 12 and a plurality of rotor stages 14 axially dispersed along the rotor body 12. As is known in the art, the LP steam turbine 4 can include a plurality of axially disposed stages 13. The stages 13 can include a first stage (L0), a second stage (L1), third stage (L2), etc. axially disposed along the LP steam turbine 4. In various embodiments, the diaphragm 10 includes at least one aperture 15 extending between an outer surface 17 and a hollow inner section 19 of the diaphragm 10.

Returning to FIG. 1, the system 2 can further include a flow path 20 coupled with the LP steam turbine 4, the IP steam turbine 5 and the HP steam turbine 6. The flow path 20 can include a flow conduit coupled with an outlet of the IP steam turbine 5 and the HP steam turbine 6. Along the flow path 20 is a steam seal header (SSH) 22 that seals a portion of the flow path 20. As is known in the art, a steam seal header 22 is a region axially proximate the interface of the flow path 20 and the steam turbine casings. The steam seal header 22 is conventionally sealed by steam from another steam source, which pressurizes the steam seal header 22 and prevents leakage of the steam from the casing of each steam turbine (LP steam turbine 4, IP steam turbine 5, HP steam turbine 6).

As shown in FIG. 1, the system 2 according to various embodiments can include an extraction conduit 24 fluidly connected with the steam seal header 22 and the diaphragm (10, FIG. 2) of the steam turbomachine section (LP steam turbine 4). The extraction conduit 24 can include a conventional metal such as a steel, alloy or other composite capable for carrying steam. The system 2 can also include a control system 26 operably connected to the extraction conduit 24 and the steam turbomachine section (e.g., LP steam turbine 4). As will be described further herein, the control system 26 can include a computerized, electrical and/or electrical/mechanical control system configured to perform the functions described herein. In various embodiments, the system 2 can include a control valve 28 coupled to the extraction conduit 24 and the control system 26. The control system 26 can be configured to actuate the control valve 28 based upon detecting of a predetermined pressure condition in the steam turbine section (LP steam turbine section 4). As will be described further herein, the control system 26 can be configured to perform certain functions, such as: a) extracting steam seal header steam from the steam seal header 22; and b) providing the extracted steam seal header steam to the diaphragm (10, FIG. 2) in response to detecting a predetermined pressure condition in the steam turbine section (LP steam turbine section 4).

As described herein, the predetermined pressure condition can include a pressure level that deviates from a threshold, e.g., a threshold range. In various embodiments, the predetermined pressure condition can include a pressure level that is below a threshold, e.g., a predetermined threshold. A drop in pressure below the threshold (threshold level or threshold range) can indicate that the steam turbine section (e.g., LP steam turbine section 4) is operating below a desired level (e.g., at a part load condition). In various embodiments, the control system 26 can divert admitted steam from the steam seal header to a higher pressure location (e.g., port) in the steam turbine section (e.g., the LP steam turbine section 4) in response to determining the steam turbine section is operating below the desired level.

As shown in FIG. 1, excess flow extracted from the steam seal header 22 can be provided to the steam turbine (e.g., e.g., LP steam turbine 4). The steam seal header 22 is shown fluidly connected with the flow path 20 e.g., where flow is shown entering the steam seal header 22 at various locations along the flow path 20. For the purposes of clarity in illustration, the steam seal header 22 is shown in two locations in FIG. 1 to illustrate connection of components within the system 2. However, it is understood that this schematic depiction is intended merely to be illustrative of the various aspects of the invention. Also shown in FIG. 1 is a dynamoelectric machine (dynamo) 23, which can include any conventional dynamoelectric machine such as an electrical generator, motor, etc. The dynamo 23 can be coupled to one or more of the turbomachines (e.g., LP steam turbine 4, IP steam turbine 5 and/or HP steam turbine 6) via any conventional means, e.g., a conventional single or multi-shaft configuration.

In various embodiments, the system 2 can further include a sensor system 30 coupled to the steam turbomachine section (LP steam turbine section 4) and the control system 26. The sensor system 30 can be configured to detect pressure condition(s) in the steam turbomachine section (LP steam turbine section 4). In various embodiments, the sensor system 30 includes a plurality of pressure sensors 32 at axially separated locations along the diaphragm (10, FIG. 2) of the steam turbomachine section (LP steam turbine section 4). The plurality of pressure sensors 32 is configured to detect pressure condition(s) at each of the axially separated locations along the diaphragm (10, FIG. 2).

In various embodiments, the sensor system 30 further includes a steam seal header pressure sensor 34 configured to detect a pressure of the extracted steam seal header steam (from the steam seal header 22). The pressure sensors described herein can include any conventional pressure sensors, e.g., a piezoelectric sensor, piezoelectric strain gauge, capacitive, electromagnetic, optical, thermal, ionization, etc.

In various embodiments, the control system 26, when coupled with the sensor system 30, is further configured to:

(I) Obtain data about the pressure of the extracted steam seal header steam from the steam seal header pressure sensor 34;

(II) Obtain data about the pressure condition proximate at least one of the axially separated locations from at least one of the plurality of sensors 32;

(III) Compare the data about the pressure of the extracted steam seal header steam with the data about the pressure condition proximate the at least one of the axially separated locations (proximate the sensors 32); and (IV) Provide the extracted steam seal header steam to the diaphragm body 10 proximate a selected one of the axially separated locations based upon a difference between the data about the pressure of the extracted steam seal header steam and the pressure condition proximate the at least one of the axially separated locations.

With reference to FIGS. 1-2, in various embodiments, the control system 26 provides the extracted steam seal header steam to a first stage (L0) or a second stage (L1) of the diaphragm 10 in response to detecting the predetermined pressure condition in the steam turbine section (LP steam turbine 4). In various embodiments, the control system 26 is configured to provide the extracted steam seal header steam directly to the diaphragm 10 in response to detecting the predetermined pressure condition in the steam turbine section. That is, the control system 26 is configured to extract the steam seal header steam and directly provide that extracted steam seal header steam to the diaphragm 10 in response to detecting the predetermined pressure condition (e.g., without mixing the extracted steam seal header steam). In some cases, the control system 26 is configured to inject the extracted steam seal header steam to stage (e.g., L0, L1, L2, etc.) of the LP steam turbine 4 that has a lower pressure level than the pressure of the extracted steam seal header steam. The control system 26 obtains data from the sensor system 30 to compare the pressure of the extracted steam seal header steam with the pressure of the working fluid (steam) inside the LP steam turbine 4.

Figure 3:
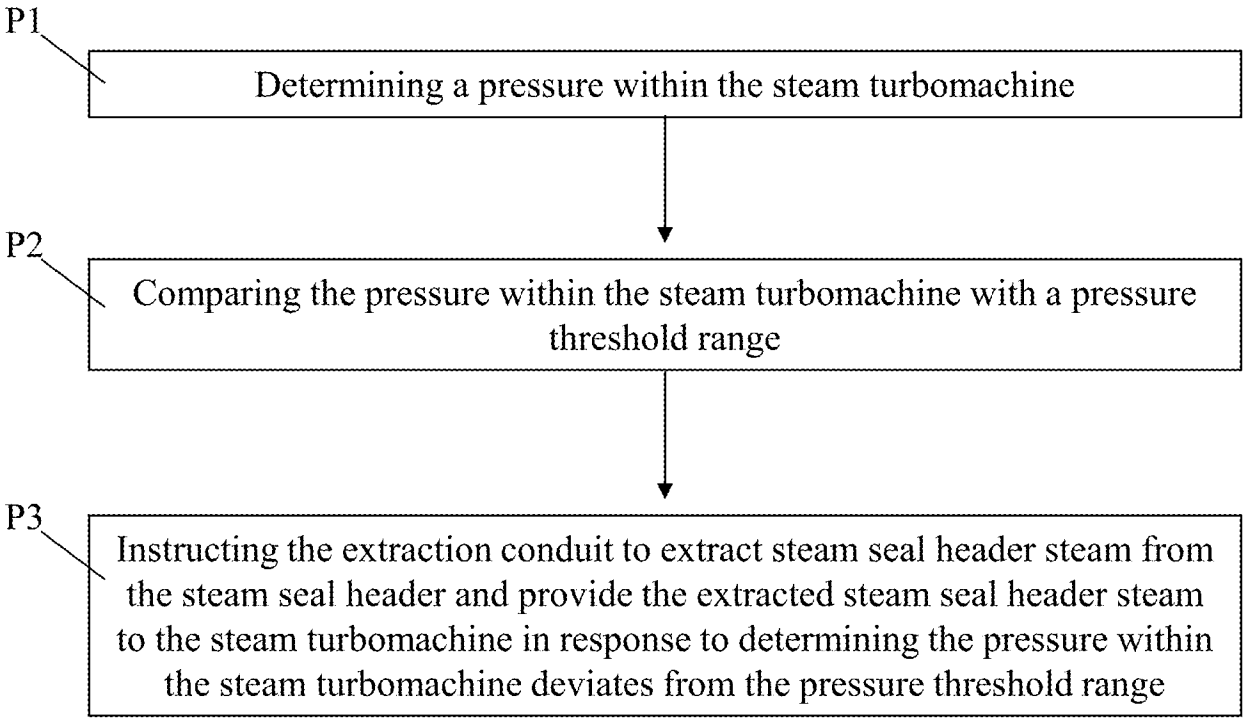
FIG. 3 is a flow diagram illustrating a process according to various embodiments of the invention.

FIG. 3 is a flow diagram illustrating processes in one method performed by the control system 26 according to various embodiments of the invention. The method can include:

Process P1: determining a pressure within the steam turbomachine 4;

Process P2: comparing the pressure within the steam turbomachine with a pressure threshold range; and Process P3: initiating the extraction conduit 24 (and the control valve 28) to extract steam seal header steam from the steam seal header 22 and provide the extracted steam seal header steam to the steam turbomachine (LP steam turbine 4) in response to determining the pressure within the steam turbomachine deviates from the pressure threshold range.

In various embodiments, the control system 26 (e.g., including at least one computing device) is further configured to determine whether the steam seal header 22 includes sufficient steam seal header steam for extraction, e.g., before the determining of the pressure within the steam turbomachine (e.g., LP steam turbine 4) (e.g., process P0). That is, the control system 26, in conjunction with the sensor system 30 and the steam seal header pressure sensor 34, can determine whether the steam seal header 22 includes a sufficient amount of steam available to provide to the steam turbomachine. In various embodiments, the pressure at the steam seal header 22 determined by the sensor system 30 (e.g., via the steam seal header pressure sensor 34) indicates whether sufficient steam seal header steam is available to extract and provide to the steam turbomachine. In this case, the steam seal header steam pressure can be compared with a pressure threshold (e.g., a predetermined pressure threshold) to determine whether the steam seal header 22 has sufficient steam (e.g., its pressure exceeds the threshold) to extract and provide to the steam turbomachine. In various embodiments, the pressure threshold is dictated based upon the pressure at the intended injection location on the steam turbomachine (e.g., LP steam turbomachine). As described herein, the injection location (e.g., aperture 15) at a particular stage (e.g., L0, L1, L2, etc.) is determined based upon a pressure differential between the pressure at that location and the pressure of the steam in the steam seal header 22. That is, in various embodiments, the control system 26 provides the extracted steam from the steam seal header 22 to the turbomachine (e.g., LP steam turbomachine 2) only where a location in the steam turbomachine has a lower determined pressure than the pressure of the steam in the steam seal header 22. Where more than one location in the steam turbomachine has a lower pressure level than the pressure of the steam in the steam seal header 22, the control system 26 can provide the extracted steam to a highest pressure location within that group of locations.

Figure 4:
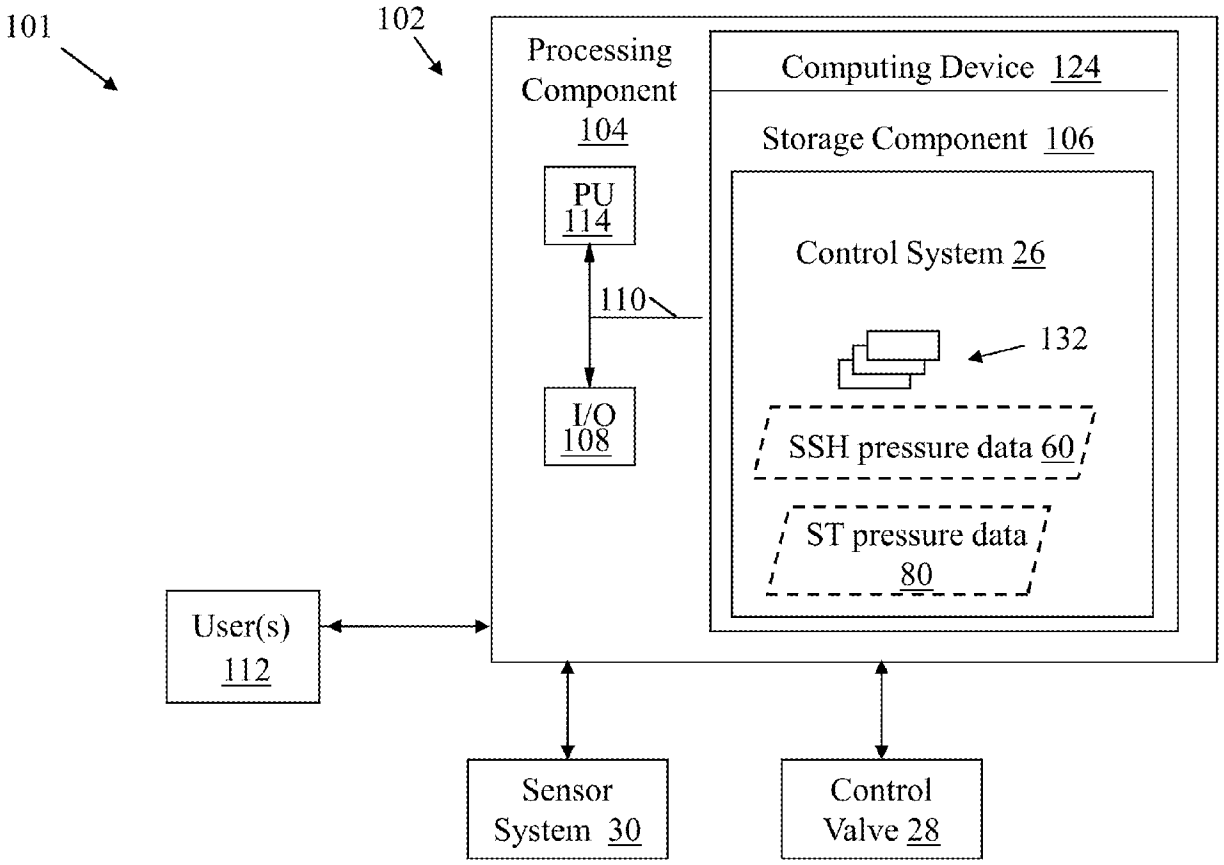
FIG. 4 shows an environment for performing various functions according to embodiments of the invention.

FIG. 4 shows an illustrative environment 101 including a control system 26, for performing the functions described herein according to various embodiments of the invention. To this extent, the environment 101 includes a computer system 102 that can perform one or more processes described herein in order to monitor a component within a turbomachine. In particular, the computer system 102 is shown as including the control system 26, which makes computer system 102 operable to monitor a component within a turbomachine by performing any/all of the processes described herein and implementing any/all of the embodiments described herein.

The computer system 102 is shown including a computing device 124, which can include a processing component 104 (e.g., one or more processors), a storage component 106 (e.g., a storage hierarchy), an input/output (I/O) component 108 (e.g., one or more I/O interfaces and/or devices), and a communications pathway 110. In general, the processing component 104 executes program code, such as the control system 26, which is at least partially fixed in the storage component 106. While executing program code, the processing component 104 can process data, which can result in reading and/or writing transformed data from/to the storage component 106 and/or the I/O component 108 for further processing. The pathway 110 provides a communications link between each of the components in the computer system 102. The I/O component 108 can comprise one or more human I/O devices, which enable a user (e.g., a human and/or computerized user) 112 to interact with the computer system 102 and/or one or more communications devices to enable the system user 112 to communicate with the computer system 102 using any type of communications link. To this extent, the control system 26 can manage a set of interfaces (e.g., graphical user interface (s), application program interface, etc.) that enable human and/or system users 112 to interact with the control system 26. Further, the control system 26 can manage (e.g., store, retrieve, create, manipulate, organize, present, etc.) data, such as steam seal header (SSH) pressure data 60 and/or steam turbine (ST) pressure data 80 using any solution. The control system 26 can additionally communicate with the sensor system 30 and/or control valve 28 via wireless and/or hardwired means.

In any event, the computer system 102 can comprise one or more general purpose computing articles of manufacture (e.g., computing devices) capable of executing program code, such as the control system 26, installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression. To this extent, the control system 26 can be embodied as any combination of system software and/or application software. It is further understood that the control system 26 can be implemented in a cloud-based computing environment, where one or more processes are performed at distinct computing devices (e.g., a plurality of computing devices 24), where one or more of those distinct computing devices may contain only some of the components shown and described with respect to the computing device 124 of FIG. 4.

Further, the control system 26 can be implemented using a set of modules 132. In this case, a module 132 can enable the computer system 102 to perform a set of tasks used by the control system 26, and can be separately developed and/or implemented apart from other portions of the control system 26. As used herein, the term "component" means any configuration of hardware, with or without software, which implements the functionality described in conjunction therewith using any solution, while the term "module" means program code that enables the computer system 102 to implement the functionality described in conjunction therewith using any solution. When fixed in a storage component 106 of a computer system 102 that includes a processing component 104, a module is a substantial portion of a component that implements the functionality. Regardless, it is understood that two or more components, modules, and/or systems may share some/all of their respective hardware and/or software. Further, it is understood that some of the functionality discussed herein may not be implemented or additional functionality may be included as part of the computer system 102.

When the computer system 102 comprises multiple computing devices, each computing device may have only a portion of control system 26 fixed thereon (e.g., one or more modules 132). However, it is understood that the computer system 102 and control system 26 are only representative of various possible equivalent computer systems that may perform a process described herein. To this extent, in other embodiments, the functionality provided by the computer system 102 and control system 26 can be at least partially implemented by one or more computing devices that include any combination of general and/or specific purpose hardware with or without program code. In each embodiment, the hardware and program code, if included, can be created using standard engineering and programming techniques, respectively.

Regardless, when the computer system 102 includes multiple computing devices 24, the computing devices can communicate over any type of communications link. Further, while performing a process described herein, the computer system 102 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

The computer system 102 can obtain or provide data, such as SSH pressure data 60 and/or ST pressure data 80 using any solution. The computer system 102 can generate SSH pressure data 60 and/or ST pressure data 80, from one or more data stores, receive SSH pressure data 60 and/or ST pressure data 80, from another system such as the sensor system 30, control valve 28 and/or the user 112, send image SSH pressure data 60 and/or ST pressure data 80 to another system, etc.

While shown and described herein as a method and system for controlling the introduction of steam seal header steam to a steam turbomachine, it is understood that aspects of the invention further provide various alternative embodiments. For example, in one embodiment, the invention provides a computer program fixed in at least one computer-readable medium, which when executed, enables a computer system to control the introduction of steam seal header steam to a steam turbomachine. To this extent, the computer-readable medium includes program code, such as the control system 26 (FIG. 4), which implements some or all of the processes and/or embodiments described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; paper; etc.

In another embodiment, the invention provides a method of providing a copy of program code, such as the control system 26 (FIG. 4), which implements some or all of a process described herein. In this case, a computer system can process a copy of program code that implements some or all of a process described herein to generate and transmit, for reception at a second, distinct location, a set of data signals that has one or more of its characteristics set and/or changed in such a manner as to encode a copy of the program code in the set of data signals. Similarly, an embodiment of the invention provides a method of acquiring a copy of program code that implements some or all of a process described herein, which includes a computer system receiving the set of data signals described herein, and translating the set of data signals into a copy of the computer program fixed in at least one computer-readable medium. In either case, the set of data signals can be transmitted/received using any type of communications link.

In still another embodiment, the invention provides a method of controlling the introduction of steam seal header steam to a steam turbomachine. In this case, a computer system, such as the computer system 102 (FIG. 4), can be obtained (e.g., created, maintained, made available, etc.) and one or more components for performing a process described herein can be obtained (e.g., created, purchased, used, modified, etc.) and deployed to the computer system. To this extent, the deployment can comprise one or more of: (1) installing program code on a computing device; (2) adding one or more computing and/or I/O devices to the computer system; (3) incorporating and/or modifying the computer system to enable it to perform a process described herein; etc.

In any case, the technical effect of the various embodiments of the invention, including, e.g., the control system 26, is to control the introduction of steam seal header steam to a steam turbomachine.

In various embodiments, components described as being "coupled" to one another can be joined along one or more interfaces. In some embodiments, these interfaces can include junctions between distinct components, and in other cases, these interfaces can include a solidly and/or integrally formed interconnection. That is, in some cases, components that are "coupled" to one another can be simultaneously formed to define a single continuous member. However, in other embodiments, these coupled components can be formed as separate members and be subsequently joined through known processes (e.g., fastening, ultrasonic welding, bonding).

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A system comprising:

at least one computing device operably connected with a steam turbomachine and an extraction conduit fluidly connected with the steam turbomachine and a steam seal header fluidly coupled with the steam turbomachine, the at least one computing device configured to modify an output of the steam turbomachine by performing actions including:

determining a pressure within the steam turbomachine;

comparing the pressure within the steam turbomachine with a pressure threshold range; and instructing the extraction conduit to extract steam seal header steam from the steam seal header and provide the extracted steam seal header steam to the steam turbomachine in response to determining the pressure within the steam turbomachine deviates from the pressure threshold range.

2. The system of claim 1, further comprising a sensor system coupled to the steam turbomachine and the at least one computing device system, the sensor system configured to detect the pressure in the steam turbomachine.

3. The system of claim 2, wherein the sensor system includes a plurality of pressure sensors at axially separated locations along the steam turbomachine, and wherein the plurality of pressure sensors are configured to detect the pressure at each of the axially separated locations.

4. The system of claim 3, wherein the sensor system further includes a steam seal header pressure sensor configured to detect a pressure of the extracted steam seal header steam.

5. The system of claim 4, wherein the at least one computing device is further configured to:

compare the pressure of the extracted steam seal header steam with the pressure level proximate the at least one of the axially separated locations; and instruct the extraction conduit to provide the extracted steam seal header steam to the steam turbomachine proximate a selected one of the axially separated locations based upon a difference between the pressure of the extracted steam seal header steam and the pressure proximate the at least one of the axially separated locations.

6. The system of claim 1, wherein the at least one computing device is further configured to determine whether the steam seal header includes sufficient steam seal header steam for extraction before the determining of the pressure within the steam turbomachine.

7. A system comprising:

a steam turbomachine section including a casing and a diaphragm at least partially contained within the casing;

a flow path fluidly coupled with the steam turbomachine section;

a steam seal header sealing a portion of the flow path;

an extraction conduit fluidly connected with the steam seal header and the diaphragm; and a control system operably connected to the extraction conduit and the steam turbomachine section, the control system configured to:

extract steam seal header steam from the steam seal header; and provide the extracted steam seal header steam to the diaphragm in response to detecting a predetermined pressure condition in the steam turbomachine section.

8. The system of claim 7, wherein the predetermined pressure condition includes a pressure condition below a predetermined threshold.

9. The system of claim 7, further comprising a sensor system coupled to the steam turbomachine section and the control system, the sensor system configured to detect the predetermined pressure condition in the steam turbomachine.

10. The system of claim 9, wherein the sensor system includes a plurality of pressure sensors at axially separated locations along the diaphragm, and wherein the plurality of pressure sensors are configured to detect the predetermined pressure condition at each of the axially separated locations.

11. The system of claim 10, wherein the sensor system further includes a steam seal header pressure sensor configured to detect a pressure of the extracted steam seal header steam.

12. The system of claim 11, wherein the control system is further configured to:

obtain data about the pressure of the extracted steam seal header steam from the steam seal header pressure sensor;

obtain data about a pressure condition proximate at least one of the axially separated locations from at least one of the plurality of sensors;

compare the data about the pressure of the extracted steam seal header steam with the data about the pressure condition proximate the at least one of the axially separated locations; and instruct the conduit to provide the extracted steam seal header steam to the diaphragm body proximate a selected one of the axially separated locations based upon a difference between the data about the pressure of the extracted steam seal header steam and the pressure condition proximate the at least one of the axially separated locations.

13. The system of claim 7, further comprising a control valve coupled to the extraction conduit and the control system, the control system configured to actuate the control valve based upon the detecting of the predetermined pressure condition in the steam turbine section.

14. The system of claim 7, wherein the diaphragm includes at least one aperture extending between an outer surface and a hollow inner section of the diaphragm.

15. The system of claim 7, wherein the control system provides the extracted steam seal header steam to a last stage or a second-to-last stage of the diaphragm in response to detecting the predetermined pressure condition in the steam turbine section.

16. A computer program product comprising program code stored on a computer readable medium, which when executed by at least one computing device, causes the at least one computing device to modify an output of a steam turbomachine by performing actions including:

determining a pressure within the steam turbomachine;

comparing the pressure within the steam turbomachine with a pressure threshold range; and initiating extraction of steam from a steam seal header connected with the steam turbomachine and providing the extracted steam seal header steam to the steam turbomachine in response to determining the pressure within the steam turbomachine deviates from the pressure threshold range.

17. The computer program product of claim 16, wherein the program code further causes the at least one computing device to detect the pressure within the steam turbomachine at a plurality of axially separated locations within the steam turbomachine.

18. The computer program product of claim 17, wherein program code further causes the at least one computing device to determine a pressure of the extracted steam seal header steam.

19. The computer program product of claim 18, wherein program code further causes the at least one computing device to:

compare the pressure of the extracted steam seal header steam with the pressure proximate the at least one of the axially separated locations; and initiate providing of the extracted steam seal header steam to the steam turbomachine proximate a selected one of the axially separated locations based upon a difference between the pressure of the extracted steam seal header steam and the pressure proximate the at least one of the axially separated locations.

* * * * *